US005820523A

United States Patent [19]

Zemer

[11] Patent Number: 5,820,523

[45] Date of Patent: Oct. 13, 1998

[54] PALM MUSCLE EXERCISER DEVICE

[76] Inventor: Uriel Zemer, Yom Hakipurim St. 26, Apt 6, Holon 58485, Israel

[21] Appl. No.: 943,015

[22] Filed: Oct. 2, 1997

[51] Int. Cl.[6] ..... A63B 23/16

[52] U.S. Cl. ..... 482/49; 482/128

[58] Field of Search ..... 482/44, 49, 121, 482/128, 122

[56] References Cited

U.S. PATENT DOCUMENTS

| | | | |
|---|---|---|---|
| 1,549,710 | 8/1925 | Campbell | 482/49 |
| 1,623,869 | 4/1927 | Giraldi | 482/49 |
| 3,542,363 | 11/1970 | Biship | 482/49 |
| 3,910,572 | 10/1975 | Denier | 482/49 |
| 4,632,383 | 12/1986 | Tsuzuki | 482/49 |
| 5,531,668 | 7/1996 | Mann et al. | 482/44 |

*Primary Examiner*—Lynne A. Reichard

[57] ABSTRACT

A palm muscle exerciser device including elliptical body constructed of a sheet of resilient flexible material. The body has a pair of end edges that fixedly attached when the material is wound around. The elliptical body has a length for extending substantially completely across the width of a palm of a hand of a user. The elliptical body has a pair of opposing end openings for allowing entry into the hollow interior thereof. A generally cylindrical tube member is sized for positioning within the elliptical body. The tube member has a plurality of air release openings therein. Lastly a rod is sized for placement within the tube member and attached to the second end of the first and second members of the tube member.

8 Claims, 3 Drawing Sheets

PALM MUSCLE EXERCISER DEVICE

BACKGROUND OF THE INVENTION

1. Field of the Invention

The present invention relates to a palm muscle exerciser device and more particularly pertains to providing a hand held device for strengthening the hands, wrist and arm forearms of the user.

2. Description of the Prior Art

The use of hand exerciser is known in the prior art. More specifically, hand exercisers heretofore devised and utilized for the purpose of exercising and strengthening the hand are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,302,165 to Caruthers, discloses exercise devices. U.S. Pat. No. 5,297,541 to Hensey discloses an athletic therapeutic glove. U.S. Pat. No. Des. 291,341 to Keating et al. discloses a hand exerciser. U.S. Pat. No. 4,711,445 to Whitehead discloses a therapeutic hand exerciser. U.S. Pat. No. 4,240,624 to Wilson discloses hand grip exercise device. Lastly, U.S. Pat. No. 4,222,560 to Hallerman discloses an exerciser and rehabilitative gripping device.

In this respect, the palm muscle exerciser device according to the present invention substantially departs from the conventional concepts and designs of the prior art, and in so doing provides an apparatus primarily developed for the purpose of providing a hand held device for strengthening the hands, wrist and arm forearms of the user.

Therefore, it can be appreciated that there exists a continuing need for a new and improved palm muscle exerciser device which can be used for providing a hand held device for strengthening the hands, wrist and arm forearms of the user. In this regard, the present invention substantially fulfills this need.

SUMMARY OF THE INVENTION

In view of the foregoing disadvantages inherent in the known types of hand exercisers now present in the prior art, the present invention provides an improved palm muscle exerciser device. As such, the general purpose of the present invention, which will be described subsequently in greater detail, is to provide a new and improved Palm muscle exerciser device which has all the advantages of the prior art and none of the disadvantages.

To attain this, the present invention essentially comprises a generally elongated elliptical body. The body is constructed of a sheet of resilient flexible material with a pair of end edges that are fixedly attached when the material is wound around. The elliptical body, when formed, has a hollow interior. The elliptical body has a diameter and the diameter is the greatest at a medial of the elliptical body. The elliptical body has a length for extending substantially completely across the width of a palm of a hand of a user. The elliptical body has a circumference for allowing the hand to wrap completely therearound, when the elliptical body is uncompressed and enables the hand to compress the elliptical body. The elliptical body has a pair of opposing end openings for allowing entry into the hollow interior thereof. Also, a generally cylindrical tube member is sized for positioning within the elliptical body. The tube member is a telescoping tube formed by a first member and a second member. The first and second members, each have a first and second end portion. The second end portion of the first and second members is mushroom-like. The second end portion of the first and second member connects with one of the pair of opposing end openings of the elliptical body. The first member has a resilient means therein. The second member is sized for slidable placement within the first member to allow the first end portion of the second member to engage the resilient means. Included is a rod. The rod is sized for placement within the tube member and passing through the resilient means. The rod is attached to the second end of the first and second member of the tube member. Lastly, an air valve is positioned within the rod and spaced from the second end portion of the first member. The air valve is movable within the tube member for air release when the elliptical body is compressed and uncompressed.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Palm muscle exerciser device which has all the advantages of the prior art hand exercisers and none of the disadvantages.

It is another object of the present invention to provide a new and improved palm muscle exerciser device which may be easily and efficiently manufactured and marketed.

It is a further object of the present invention to provide a new and improved palm muscle exerciser device which is of a durable and reliable construction.

An even further object of the present invention is to provide a new and improved palm muscle exerciser device which is susceptible of a low cost of manufacture with regard to both materials and labor, and which accordingly is then susceptible of low prices of sale to the consuming public, thereby making such Palm muscle exerciser device economically available to the buying public.

Still yet another object of the present invention is to provide a new and improved palm muscle exerciser device which provides in the apparatuses and methods of the prior art some of the advantages thereof, while simultaneously overcoming some of the disadvantages normally associated therewith.

Still another object of the present invention is to providing a hand held device for strengthening the hands, wrist and arm forearms of the user.

Lastly, it is an object of the present invention to provide a new and improved elliptical body constructed of a sheet of resilient flexible material. The body has a pair of end edges that fixedly attached when the material is wound around. The elliptical body has a length for extending substantially completely across the width of a palm of a hand of a user. The elliptical body has a pair of opposing end openings for allowing entry into the hollow interior thereof. A generally cylindrical tube member is sized for positioning within the elliptical body. The tube member has a plurality of air release openings therein. Lastly a rod is sized for placement within the tube member and attached to the second end of the first and second members of the tube member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
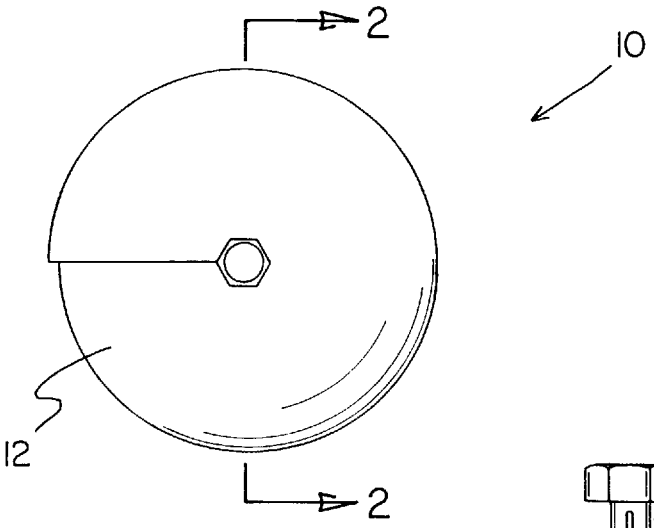
FIG. 1 is a perspective illustration of the preferred embodiment of the palm muscle exerciser device constructed in accordance with the principles of the present invention.

With reference now to the drawings, and in particular to FIG. 1 thereof, a new and improved palm muscle exerciser device embodying the principles and concepts of the present invention and generally designated by the reference numeral 10 will be described.

The present invention, the new and improved palm muscle exerciser device, is comprised of a plurality of components. Such components in their broadest context include a body, a tube member and a rod. Such components are individually configured and correlated with respect to each other so as to attain the desired objective.

Figure 2:
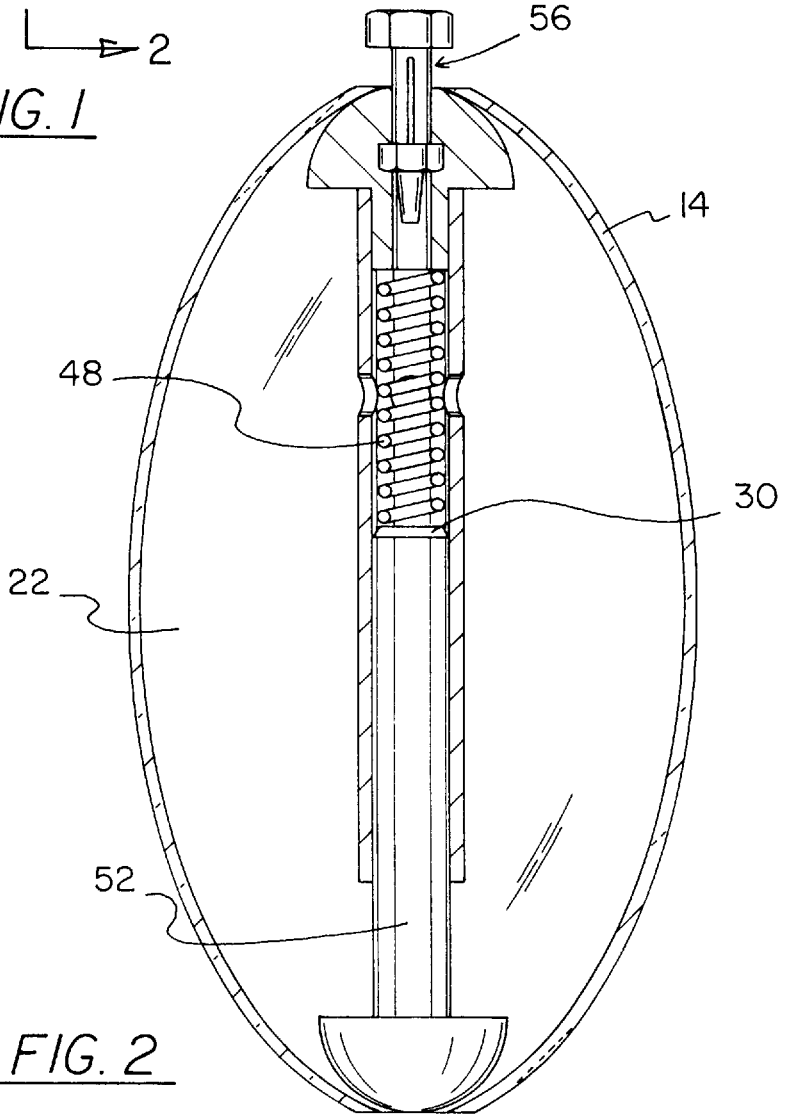
FIG. 2 is a cross-sectional view of the present invention taken along line 2—2 of FIG. 1.

More specifically, the present invention includes a generally elongated elliptical body 12. The elliptical body, as shown in FIG. 2 is constructed of a sheet of resilient flexible material 14, preferably polyester thermo plastic. The sheet has a pair of end edges 16 and 18 that are fixedly attached when the material is wound around its axis into an operable orientation. The elliptical body, when formed, has a hollow interior 22. The elliptical body has a diameter that varies with the greatest diameter at a medial of the elliptical body. The elliptical body has a length for extending substantially completely across the width of a palm of a hand of a user. The elliptical body has a circumference for allowing the hand to wrap completely therearound, when the elliptical body is uncompressed and enables the hand to compress the elliptical body. The shape accommodates the decreasing diameter of the palm of the hand. The elliptical body has a pair of opposing end openings 26 and 28 for allowing entry into the hollow interior thereof.

Figure 3:
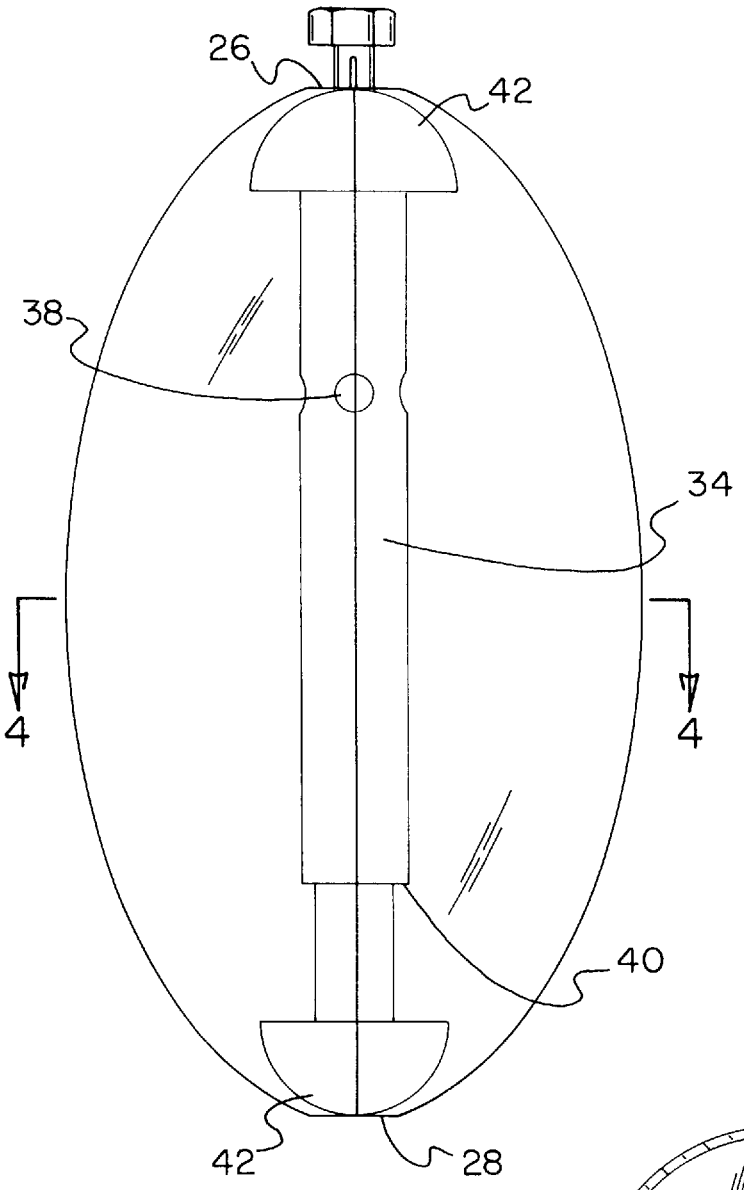
FIG. 3 is a side view of the present invention in an uncompressed orientation of FIG. 1.
Figure 4:
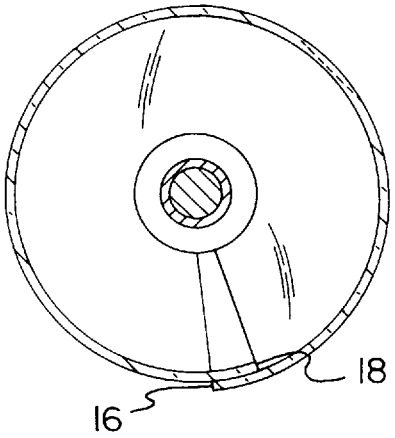
FIG. 4 is a cross-sectional view of the present invention taken along line 4—4 of FIG. 3 showing the uncompressed orientation.
Figure 5:
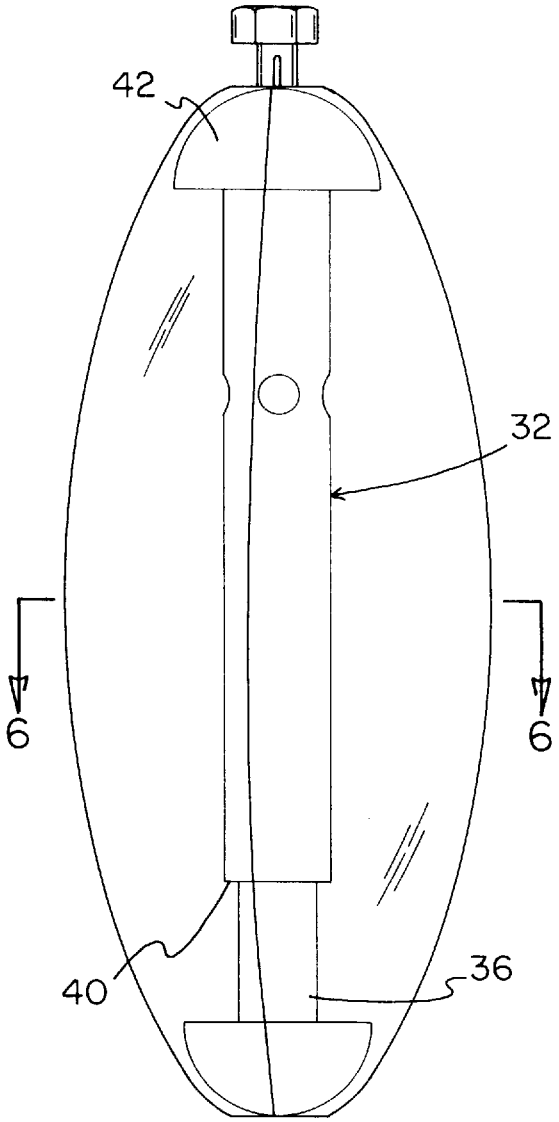
FIG. 5 is a side view of the present invention in a compressed orientation.
Figure 6:
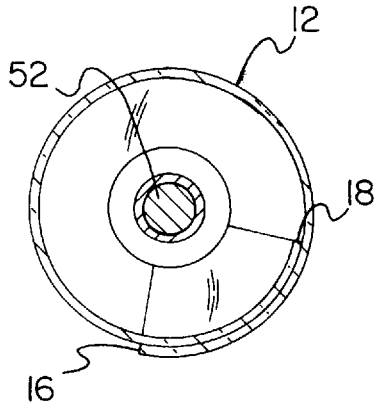
FIG. 6 is a cross-sectional view of the present invention taken along line 6—6 of FIG. 5 showing the compressed orientation.

Also, a generally cylindrical tube member 32, as shown in FIG. 3, is sized for positioning within the elliptical body. The tube member is a telescoping tube formed by a first member 34 and a second member 36. The first member has a plurality of air release openings 38 therethrough. The first and second members, each have a first end portion 40 and second end portion 42. The second end portion of the first and second members is essentially semi-hemispherical, as seen in FIG. 5. The second end portion of the first and second member connects with one of the pair of opposing end openings of the elliptical body. The first member has a resilient means 48 therein. Preferably the resilient means is a compression spring. The second member is sized for slidable placement within the first member to allow the first end portion of the second member to engage the resilient means.

Included is a rod 52. The rod is sized for placement within the tube member 32. The rod passing through the resilient means, as depicted in FIG. 2. The rod is attached to the second end of the first and second member of the tube member.

Lastly, an air valve 56 is provided. The air valve is positioned within the rod and spaced from the second end portion of the first member. The air valve is movable within the tube member for air release when the elliptical body is compressed and uncompressed. When the body is compressed air is forced into the air release openings of the first member to force the valve upward for release of the air. When the body is uncompressed air is sucked into through the air valve to refill the hollow interior of the body.

Furthermore, the elliptical body of the present invention may function as a spring-like device for exercising the palm muscle. The material used to form the sheet is readily contractable. When the pair of end edges 16 and 18 are allowed to remain detached and to merely overlap, external inwardly directed radial forces can contract the elliptical body. The internal stress of the elliptical body always acts against and in direct proportion to the amount of the externally applied force or forces, tending to reassume the initial state and relative positions of the pair of end edges. Finally, as apposed to using the air valve a coiled leaf spring may be employed.

The preferred embodiment of the present invention palm muscle exerciser device is an elliptical hand-held exerciser which operates by a squeezing motion. The body of the invention is hollow and formed from a sheet of flexible plastic. This material is wound around itself to from an ellipsoid-shaped cavity with ends that partially overlap. Within the present invention is a rod that passes through a tube member to connect the first and second end portions. A coil compression spring is found between the mushroom-like end portions of the first and second member of the tube member. The coil creates the resistance which makes the device function effectively. When the user squeezes the present invention, the device will contract automatically, causing the ends to overlap even further. Releasing the pressure causes the product to spring back to its original size.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved palm muscle exerciser device comprising in combination:

a generally elongated elliptical body constructed of a sheet of resilient flexible material with a pair of end edges being fixedly attached when the material is wound around it axis into an operable orientation, the elliptical body when formed having a hollow interior, the elliptical body having a diameter with the diameter being the greatest at a medial of the elliptical body, the elliptical body having a length for extending substantially completely across the width of a palm of a user, the elliptical body having a circumference for allowing the hand to wrap completely therearound uncompressed and enabling the hand to compress the elliptical, the elliptical body having a pair of opposing end openings for allowing entry into the hollow interior thereof;

a generally cylindrical tube member being sized for positioning within the elliptical body, the tube member being a telescoping tube formed by a first member and a second member, the first and second member each having a first and second end portion, the second end portion of the first and second member being essentially semi-hemispherical, the second end portion of the first and second member connecting with one of the pair of opposing end openings of the elliptical body, the first member having a resilient means therein, the second member being sized for slidable placement within the first member for allowing the first end portion of the second member to engage the resilient means;

a rod being sized for placement within the tube member and passing through the resilient means, the rod being attached to the second end of the first and second member of the tube member; and an air valve being positioned within the rod and spaced from the second end portion of the first member, the air valve being movable within the tube member for air release when the elliptical body is compressed and uncompressed.

2. A palm muscle exerciser device comprising:

an elliptical body constructed of a sheet of resilient flexible material with a pair of end edges being fixedly attached when the material is wound around its axis into an operable orientation, the elliptical body having a length for extending substantially completely across the width of a palm of a user, the elliptical body having a pair of opposing end openings for allowing entry into the hollow interior thereof;

a generally cylindrical tube member being sized for positioning within the elliptical body, the tube member having a plurality of air release openings therein; and a rod being sized for placement within the tube member, the tube member has a first member and a second member with each having a second end, the rod is attached to the second end of the first and second members.

3. The palm muscle exerciser device as set forth in claim 2, wherein the elliptical body, when formed, has a hollow interior, the elliptical body has a diameter with the diameter being the greatest at a medial of the elliptical body, and the elliptical body has a circumference for allowing the hand to wrap completely therearound when the elliptical body is uncompressed and enabling the hand to compress the elliptical body.

4. The palm muscle exerciser device as set forth in claim 3, wherein the tube member is a telescoping tube formed by a first member and a second member.

5. The palm muscle exerciser device as set forth in claim 4, wherein the first and second member each has a first end portion and second end portion, the second end portion of the first and second member is semi-hemispherical, and the second end portion of the first and second member connects with one of the pair of opposing end openings of the elliptical body.

6. The palm muscle exerciser device as set forth in claim 5, wherein the first member has a resilient means therein, and the second member is sized for slidable placement within the first member for allowing the first end portion of the second member to engage the resilient means.

7. The palm muscle exerciser device as set forth in claim 2 wherein, the rod, when positioned within the tube member, passes through the resilient means.

8. The palm muscle exerciser device as set forth in claim 2, further including an air valve is positioned within the rod and spaced from the second end portion of the first member, and the air valve is movable within the tube member for air release when the elliptical body is compressed and uncompressed.

* * * * *